United States Patent [19]

Howes

[11] 4,274,596

[45] Jun. 23, 1981

[54] FUEL INJECTION NOZZLES

[76] Inventor: Peter Howes, 45 Birchdale, Gerrards Cross, Buckinghamshire, England

[21] Appl. No.: 80,162

[22] Filed: Sep. 28, 1979

[30] Foreign Application Priority Data

Nov. 17, 1978 [GB] United Kingdom ..... 45088/78

[51] Int. Cl.[3] ..... F02M 61/20

[52] U.S. Cl. ..... 239/533.9

[58] Field of Search ..... 239/533.2, 533.9, 533.13, 239/533.14, 88

[56] References Cited

U.S. PATENT DOCUMENTS 2,530,128 11/1950 Mashinter ..... 239/88 X 2,775,484 12/1956 Fox ..... 239/533.2 X

FOREIGN PATENT DOCUMENTS 212082 11/1960 Austria ..... 239/533.9

*Primary Examiner*—Richard A. Schacher

[57] ABSTRACT

A fuel injection nozzle includes a valve assembly located within a chamber defined in a body part to which fuel is supplied through an inlet. The wall of the chamber is resilient whereby during the initial delivery of fuel to the injection nozzle the wall deflects to store fuel whereby the initial rate of flow of fuel to the engine will be at a reduced rate.

6 Claims, 5 Drawing Figures

FUEL INJECTION NOZZLES

Figure 1:
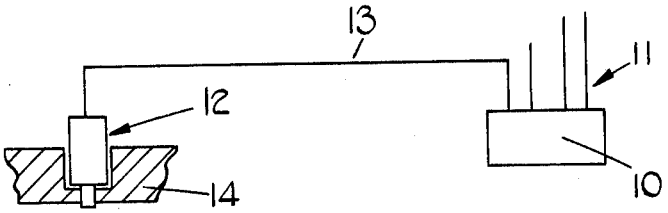

This invention relates to fuel injection nozzles for supplying fuel to compression ignition internal combustion engines and of the kind comprising a hollow body part; a valve assembly including a resiliently loaded valve member and a seating, the valve assembly being located within the body part with a valve head forming part of the assembly being exposed at or beyond one end of the body part, and a fuel inlet communicating with the interior of the body part, the arrangement being such that in use, when fuel under pressure is supplied to the inlet, the fuel pressure within the body part acting upon the components of the valve assembly will effect movement of the valve head away from the body and the seating to permit fuel to flow past the valve head and seating into in use, the respective combustion chamber of the associated engine.

In use, the nozzle is secured within a bore in the cylinder head of an engine so that fuel flowing past the valve head and seating is atomised and is injected directly into the combustion space of the engine. The fuel is supplied by an injection pump which operates in timed relationship with the engine and which may supply fuel to other nozzles of the engine. The rate of fuel flow to the engine during the period of fuel delivery has a bearing on the amount of noxious gas in the engine exhaust and it has been found that the rate of flow of fuel through the nozzle should increase relatively slowly at the start of injection and decrease as rapidly as possible at the end of injection.

It is known to incorporate various types of devices in the fuel conveying conduit between the pump and the nozzle or even within the nozzle, which act to provide the desired initial rate of fuel flow. These devices are however, complex and therefore costly and generally comprise some form of valve which limits the initial flow rate by providing temporary storage for some of the fuel flowing from the pump. Since the type of nozzle set out in the first paragraph is well known as being a comparatively cheap form of nozzle as compared with the more conventional form of nozzle in which the valve member moves in a direction away from said one end of the body part, it is not appropriate to have to provide an expensive valve to control the rate of fuel flow.

The object of the invention is to provide a nozzle of the kind specified in a simple and convenient form.

According to the invention a nozzle of the kind specified includes an annular elongated part located within the body part, said elongated part surrounding the portion of the valve assembly lying within the body part, said elongated part acting to define part of the wall of a chamber to which fuel under pressure is supplied from the inlet and from which fuel flows when the head is moved out of contact with the seating, the wall thickness of said elongated part being such that the wall deflects during the initial delivery of fuel to the nozzle thereby to store part of the initial flow of fuel whereby the initial rate of flow of fuel past the valve head and seating will be at a reduced rate.

According to the further feature of the invention said annular elongated part defines an annular space with the surrounding body part, said space in use being substantially at atmospheric pressure.

Figure 2:
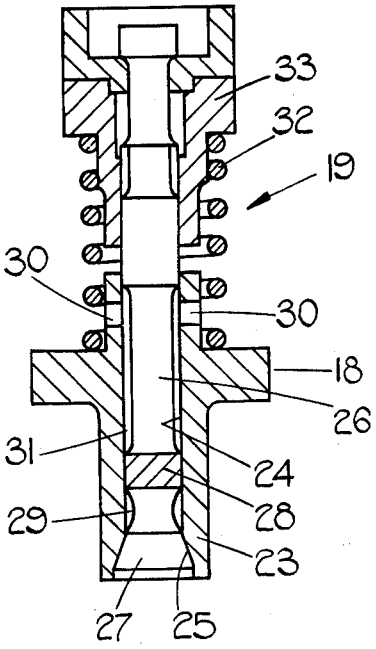
Figure 3:
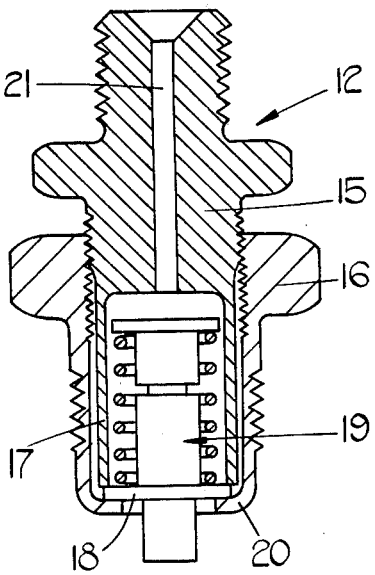
Figure 4:
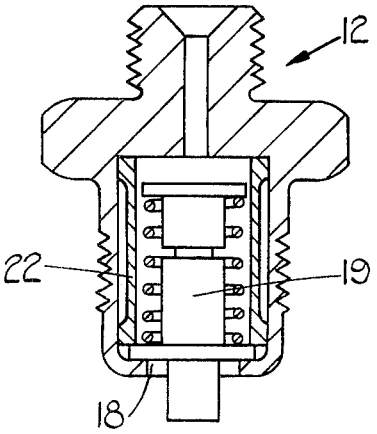
Figure 5:
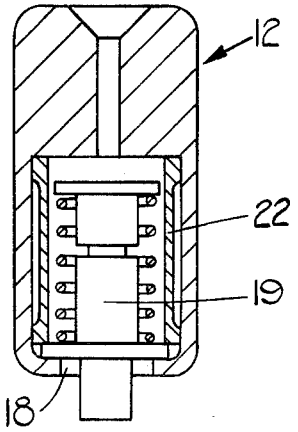

In the accompanying drawings:

FIG. 1 shows a diagram of a fuel system incorporating a nozzle in accordance with the invention, FIG. 2 shows to an enlarged scale, the valve assembly of the nozzle, FIGS. 3, 4 and 5 are sectional side elevations showing various forms of the nozzle.

Referring to FIG. 1 of the drawings an engine fuel system includes a pump 10 which in use is driven in timed relationship with the associated engine. The pump is provided with a plurality of outlets indicated at 11 and each of these outlets is connected to a respective injection nozzle one of which is indicated at 12, by means of a fuel supply line 13. The nozzle 12 in use, is located within a bore formed in the cylinder head 14 of the engine so that the inner end of the nozzle projects into a combustion space of the engine.

Turning now to FIG. 3 the nozzle 12 comprises a body part which is formed in two parts 15, 16. The part 16 is of hollow form and is provided with a peripheral screw thread for engagement in use, in the bore formed in the cylinder head of the engine. In addition, the part 16 is provided with a hexagonal portion for engagement by a spanner or the like to enable the nozzle to be tightened within the aforesaid bore.

The part 15 is provided with a hexagonal section intermediate its ends and on opposite sides of the hexagonal section, two sets of peripheral screw threads. The part 16 is internally threaded to receive one of the sets of screw threads on the part 15. Moreover, the part 15 defines an annular skirt portion 17 which extends within the part 16 for engagement with a flange 18 of a valve assembly generally indicated in FIG. 3 at 19, the other side of the flange being urged when the parts 15 and 16 are tightened, into sealing engagement with an inwardly directed end portion 20 of the part 16.

In addition, the part 15 is provided with a longitudinal passage 21 which is shaped at its outer end, to receive the shaped end of the fuel line 13. The threads at this end of the part 15 of the body are provided for engagement by a retaining nut which acts to retain the fuel line relative to the part 15.

It will be noted that the skirt portion 17 defines an outer annular space with the internal wall of the part 16 of the body part and conveniently this space in use, communicates with the atmosphere by way of a passage (not shown). The skirt portion 17 is of thin section for a purpose to be described but it does act as part of the wall of a chamber to which fuel under pressure is supplied by the injection pump.

In the arrangement shown in FIGS. 4 and 5 the body part is of one piece construction and the valve assembly 19 is held in position within the body part by rolling over the end portion of the body part into contact with the flange 18 after the valve assembly has been located in the body part. It should be noted however, that in the arrangements shown in FIGS. 4 and 5 a separate annular member 22 is provided which corresponds to the skirt portion 17 of the example shown in FIG. 3. As before, there is defined between the annular member 22 and the wall of the body part, an annular space which communicates with the atmosphere.

The nozzle shown in FIG. 4 has a screw thread whereby it can be secured within the bore and it is also provided with a screw thread for engagement by a nut for retaining the fuel line. In the arrangement shown in FIG. 5 the nozzle is devoid of screw threads and it is held within the bore by a nut which also serves to retain the shaped end of the fuel line in contact with the body.

The valve assembly 19 will now be described with reference to FIG. 2. The flange 18 is formed on the periphery of a tubular member 23 having an internal bore 24 which at its lower end is shaped to define a seating 25. Slidable within the bore is a valve member 26 having at its end adjacent the seating a head 27 for co-operation with the seating. Also provided on the valve member is a helically fluted portion 28 which co-operates with the wall of the bore to guide the movement of the valve member. Intermediate the portion 28 and the head 27 the valve member is provided with a recessed portion 29. Moreover, the tubular member is provided with a pair of ports 30 adjacent its opposite end and these communicate with the interior of the aforesaid chamber to permit fuel flow along an annular clearance 31 defined between the wall of the bore 24 and a length of the valve member which is of reduced section.

The valve member is biased to the closed position i.e. the position shown in the drawings in which the head 27 is in contact with the seating 25, by means of a coiled compression spring 32 disposed between the flange 18 and an abutment 33. The abutment 33 is engaged about a portion of the valve member which extends from the bore 24 and conveniently this is of two part construction to facilitate the assembly thereof.

In use, fuel supplied through the passage 21 acts upon the valve member to urge the valve member downwardly as shown in the drawings thereby lifting the head 27 from the seating 25. Such movement is of course against the action of the spring 32. When this movement occurs fuel from the chamber flows through the ports 30, along the clearance 31 through the channels defined by the fluted portion 28, through the clearance 29 and between the valve head and the seating. The fuel emerges from the nozzle as a finely divided spray which is directed into the combustion chamber of the engine.

As explained earlier in the specification it is desirable that the initial rate of flow of fuel to the combustion chamber should increase slowly. This is obtained by allowing the skirt portion 17 or the annular member 22, to flex outwardly under the action of the pressure of fuel supplied through the passage 21. The wall thickness therefore of the skirt portion 17 or the annular member 22 must be so chosen that the desired amount of flexure is obtained for the particular application. Towards the end of the period of delivery of fuel by the pump the pressure reduces. During this period the wall of the skirt portion 17 in the annular member 22 regains its original dimension and in so doing the volume of the chamber reduces thereby expelling fuel from the chamber. The pump will incorporate a delivery valve or a plurality of delivery valves depending upon the type of pump, which act when the delivery of fuel ceases, to unload the fuel line thereby allowing rapid closure of the valve member 27 onto the seating 25.

I claim:

1. A fuel injection nozzle for supplying fuel to a compression ignition engine comprising a hollow body part, a valve assembly including a resiliently loaded valve member and a seating, the valve assembly being located within the body part with a valve head forming part of the assembly being exposed at or beyond one end of the body part, and a fuel inlet communicating with the interior of the body part, the arrangement being such that in use, when fuel under pressure is supplied to the inlet, the fuel pressure within the body part acting upon the components of the valve assembly will effect movement of the valve head away from the body and the seating to permit fuel to flow past the valve head and seating into in use, the respective combustion chamber of the associated engine, the nozzle being characterized by an annular elongated part located within the body part, said elongated part surrounding the portion of the valve assembly lying within the body part, said elongated part acting to define part of the wall of a chamber to which fuel under pressure is supplied from the inlet and from which fuel flows when the head is moved out of contact with the seating, the wall thickness of said elongated part being such that the wall deflects outwardly during the initial delivery of fuel to the nozzle thereby to store part of the initial flow of fuel whereby the initial rate of flow of fuel past the valve head and seating will be at a reduced rate.

2. A nozzle according to claim 1 in which said annular part defines an annular space with the surrounding body part, said annular space in use being substantially at atmospheric pressure.

3. A nozzle according to claim 1 in which said hollow body part is formed in two parts one of said parts being of hollow form having an inwardly directed end portion for engagement by a flange on the valve assembly, the other of said parts being engageable within said one part and having an integral skirt portion for engagement with said flange to retain the valve assembly within the body, said skirt portion constituting said annular elongated part, said fuel inlet being formed in said other part.

4. A nozzle according to claim 3 including complementary screw threads on said parts of the body, said threads acting to retain said parts of the body part relative to each other.

5. A nozzle according to claim 1 in which said annular elongated part comprises an annular member which is located within said body part.

6. A nozzle according to claim 5 including a flange on the valve assembly said flange being retained between said annular member and a portion of said body part.

* * * * *